US006280114B1

(12) United States Patent
To

(10) Patent No.: US 6,280,114 B1
(45) Date of Patent: Aug. 28, 2001

(54) RING BINDER HAVING ACTUATING LEVER WITH CUSHION MEMBER

(75) Inventor: Chun Yuen To, Kauto Shan Shatin N.T. (HK)

(73) Assignee: World Wide Stationary Mfg., Co., Ltd., New Territories (HK)

( * ) Notice: Subject to any disclaimer, the term of this patent is extended or adjusted under 35 U.S.C. 154(b) by 0 days.

(21) Appl. No.: 09/680,982

(22) Filed: Oct. 6, 2000

Related U.S. Application Data

(63) Continuation-in-part of application No. 09/539,712, filed on Mar. 31, 2000.

(51) Int. Cl.[7] ..... B42F 13/20

(52) U.S. Cl. ..... 402/38; 402/41; 402/36; 402/26; 402/31

(58) Field of Search ..... 402/4, 26, 31, 402/36, 38, 41, 46; 128/206.27

(56) References Cited

U.S. PATENT DOCUMENTS 1,857,287 * 5/1932 Schade ..... 402/38
6,032,668 * 3/2000 Chung ..... 128/206.27

* cited by examiner

*Primary Examiner*—Willmon Fridie, Jr.
(74) *Attorney, Agent, or Firm*—Birch, Stewart, Kolasch & Birch, LLP

(57) ABSTRACT

A ring binder includes a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes a tab having a pair of spaced-apart apertures therein. A cushion member is located on the tab, which includes an inner cushion part and an outer cushion part which are interconnected by a pair of connecting parts which extend through the spaced-apart apertures in the tab to securely attach the cushion member to the tab. The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

20 Claims, 4 Drawing Sheets

RING BINDER HAVING ACTUATING LEVER WITH CUSHION MEMBER

This application is a continuation-in-part of Application Ser. No. 09/539,712 filed on Mar. 31, 2000, the entire contents of which are hereby incorporated by reference.

BACKGROUND OF THE INVENTION

1. Field of the Invention

The present invention relates to a ring binder having an improved actuating lever for opening and closing rings of the ring binder, and more particularly, to an actuating lever having a cushion member for improving tactile characteristics of the actuating lever.

2. Description of the Background Art

Ring binders are known which have a substantially rigid upper plate supporting a pair of hinged leaves pivotally movable relative to each other. A number of half-rings are attached to each of the hinged leaves so that pivoting of the hinged leaves will open or close the half-rings in a snapping motion. This motion is caused by movement of actuating levers located at each end of the ring binder.

Conventional actuating levers are typically formed of stamped metal having sufficient rigidity to transmit the forces necessary to open and close the rings. However, the snapping action produces undesirable shock forces which are transmitted to the fingers of the user. Also, because the actuating levers are formed of metal which it typically nickel plated, the actuating levers can become slippery, causing the user's fingers to slip off of the actuating lever, possibly resulting in injury to the user. Additionally, conventional actuating levers have an outwardly turned lip around most of the perimeter to rigidify and reinforce the actuating lever. This edge of the lip can be sharp and uncomfortable to press with the fingers when attempting to close the rings.

One attempt has been made to provide a cover for an actuating lever, as shown in U.S. Pat. No. 5,234,276. The purpose of the cover therein is to make metal actuating levers easier on the fingers of the binder operator and/or to make the actuating levers longer so that more leverage is available. The cover is formed of two hinged plastic pieces that are snapped together to completely encase the actuating lever. Unfortunately, the plastic cover is susceptible to breakage, especially the tiny interlocking studs which hold the two halves together. The hinge can provide sharp edges, especially at the corners, and the seam between the mating halves can collect dirt and dust. Also, the hinge is susceptible to breakage. In addition, the cover is rigid, and rather large and cumbersome, approximately three times the size of the actuating lever, resulting in an unpleasant appearance.

There is a need in the art for a ring binder having actuating levers which are comfortable to use and slip resistant, and which minimize the feedback of undesirable shock forces produced by the snap action of the rings when opening and closing the rings.

SUMMARY OF THE INVENTION

The present invention fulfills the aforementioned need in the art by providing a ring binder including a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members.

Each actuating lever includes a tab with a cushion member thereon. The tab has a pair of spaced-apart apertures extending therethrough. The cushion member includes an inner cushion part and an outer cushion part which are interconnected by a pair of connecting parts which extend through the spaced-apart apertures in the tab to securely attach the cushion member to the tab.

The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
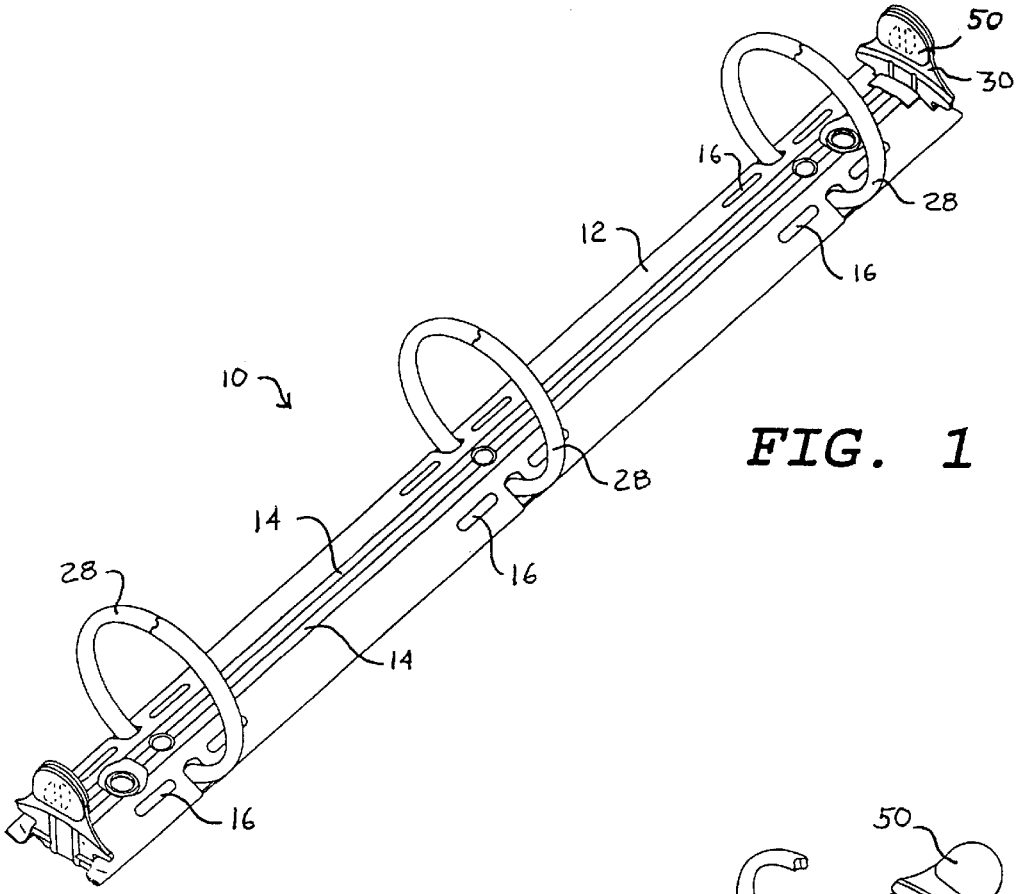
FIG. 1 is a perspective view showing the upper side of the ring binder of the present invention with the rings in a closed position.
Figure 2:
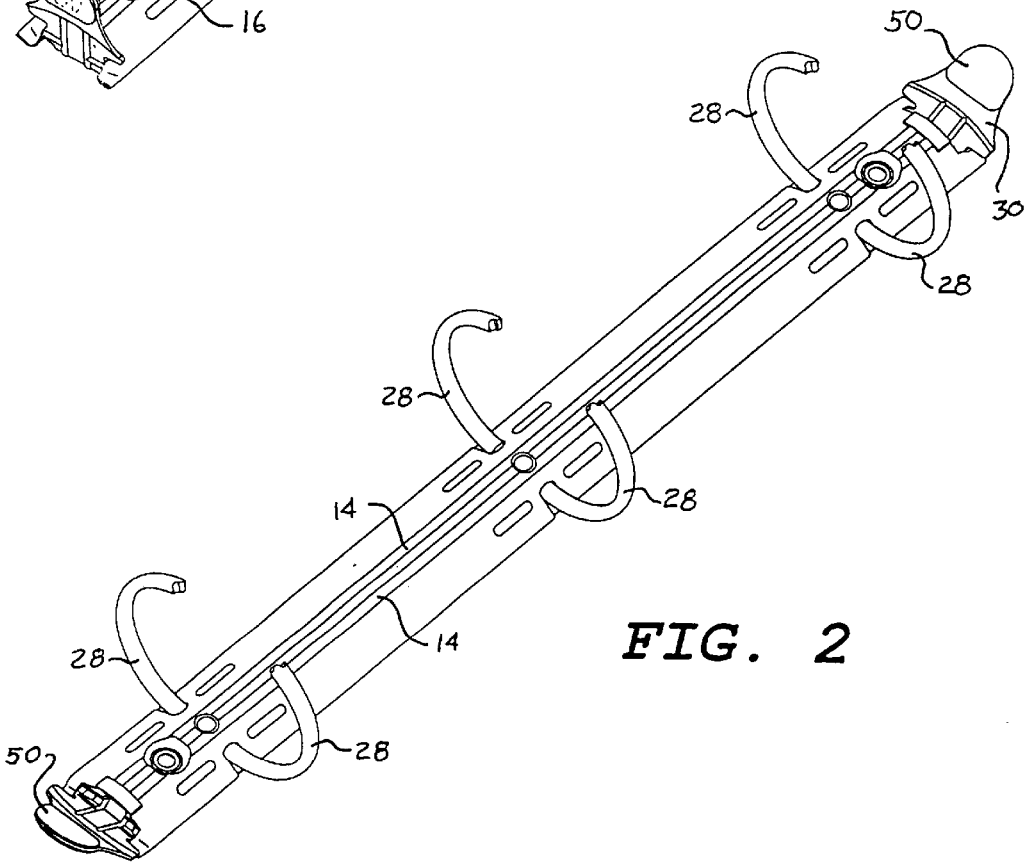
FIG. 2 is a perspective view showing the upper side of the ring binder of the present invention with the rings in an open position.
Figure 3:
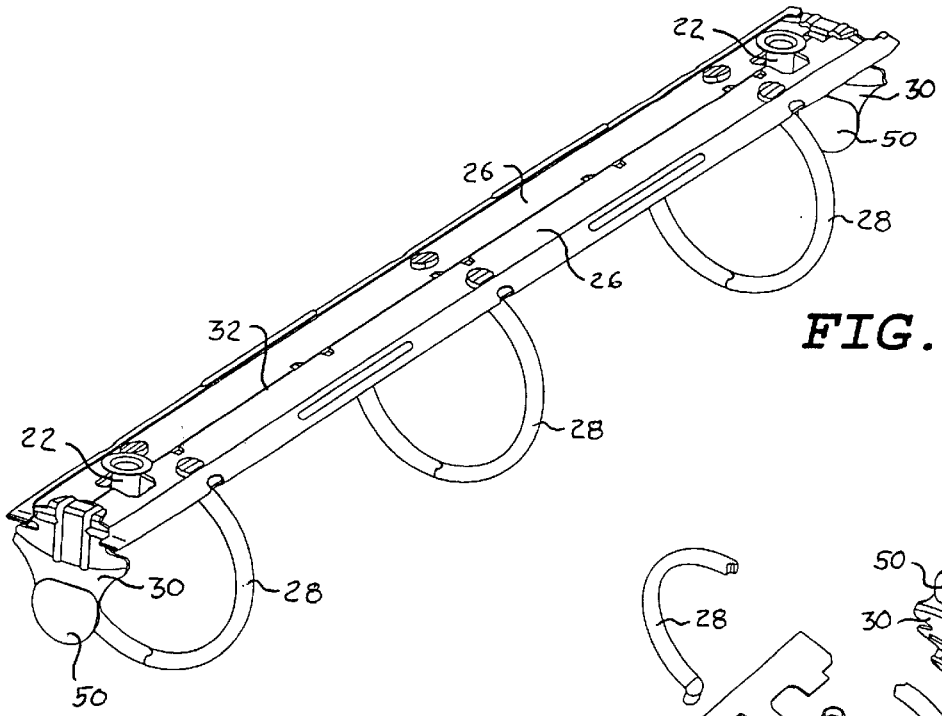
FIG. 3 is a perspective view showing the underside of the ring binder.
Figure 4:
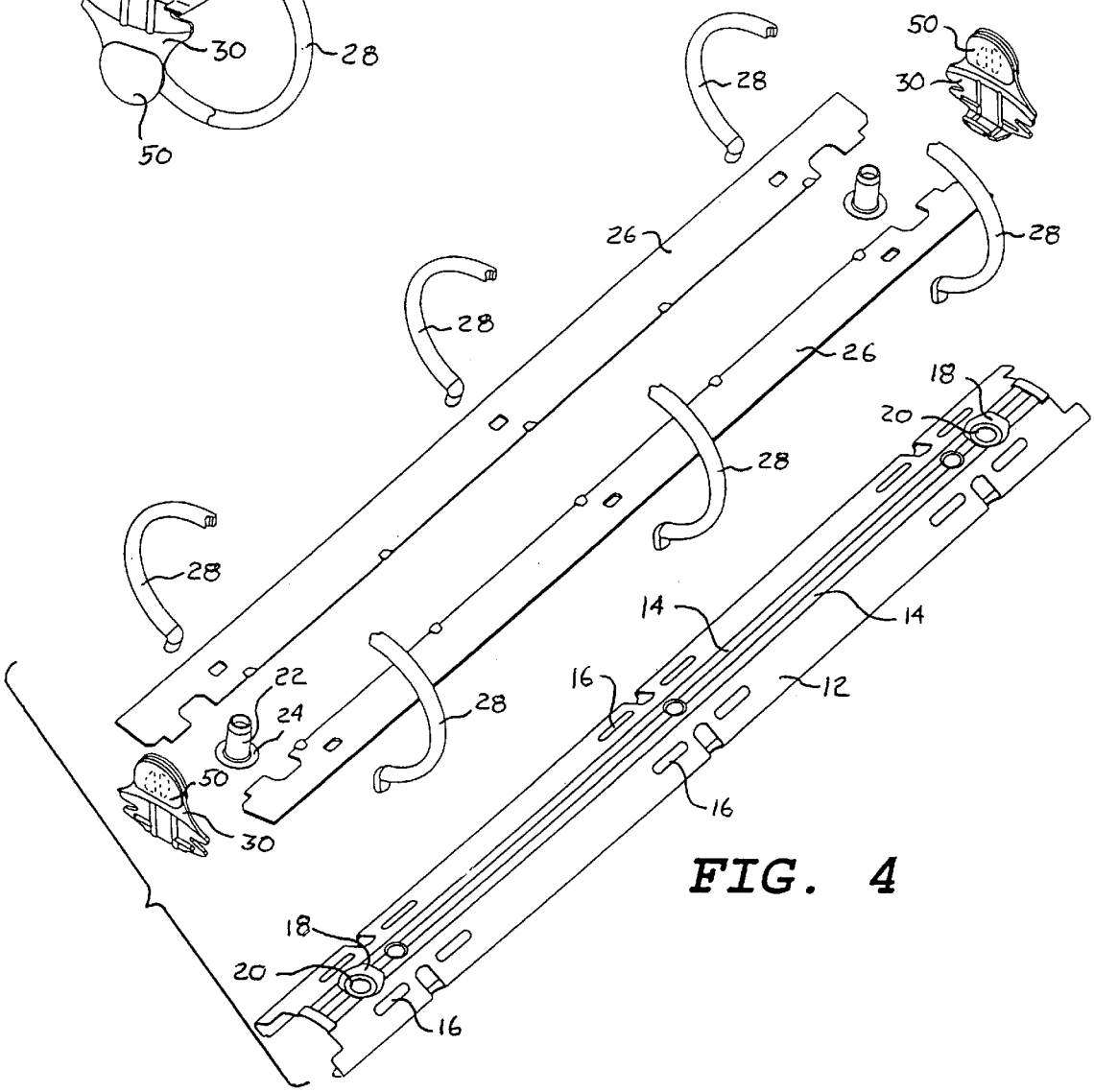
FIG. 4 is an exploded perspective view of the ring binder.

Referring in detail to the drawings, and with particular reference to FIGS. 1–4, a ring binder of the present invention is shown. The ring binder 10 is securable to a cover member (not shown) to produce a loose-leaf binder. The cover member preferably includes a spine located between front and back covers of the cover member. The ring binder 10 may be attached to the cover member by any conventional fasteners, such as rivets, which extend through the cover member and which are deformed, for example, by punching, to securely and permanently fix the ring binder 10 to the cover member.

The ring binder 10 includes a substantially rigid curved upper plate 12. The curved upper plate 12 includes a pair of first reinforcing ribs 14 extending longitudinally along the center thereof which protrude upwardly and outwardly from an outer surface of the curved upper plate 12, thereby increasing the resistance of the curved upper plate 12 to bending. The first ribs 14 extend substantially along the entire length of the curved upper plate 12 from one end to another. The curved upper plate 12 further includes several pairs of second ribs 16 which protrude upwardly and outwardly from an outer surface of the curved upper plate 12 and which are located outwardly of the first ribs 14.

The curved upper plate 12 further includes a depression 18 near each end thereof. Each depression 18 includes an aperture 20 extending through the curved upper plate 12. A cylindrical post 22 is attached to the curved upper plate 12 at the depression 18. One end of the cylindrical post 22 is secured within the aperture 20, for example, by pressing. The other end of the cylindrical post pair of grooves 38 on opposite side edges which form a pivot axis of the actuating lever 30. A lower portion of the main body 34 includes a hook member 40 which engages and moves the hinged leaves 26. An upper portion of the main body 34 is the portion engaged by the fingers of the user to pivot the actuating lever 30 about the pivot axis defined by the grooves 38, in order to open and close the ring members 28 of the ring binder 10.

Figure 5:
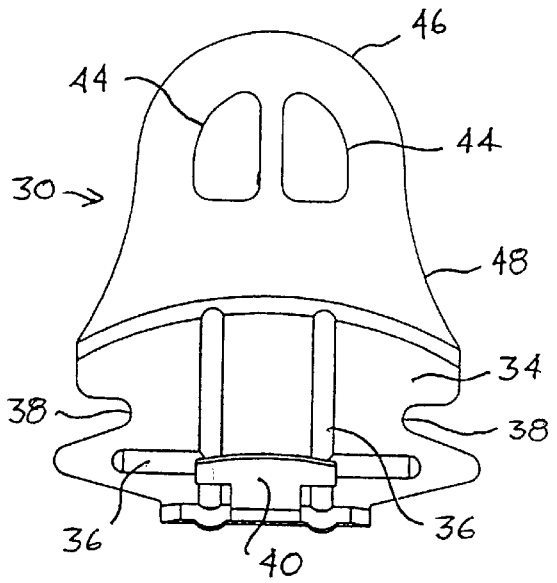
FIG. 5 is a view of the inner side of the actuating lever of the present invention with the cushion member removed therefrom.
Figure 6:
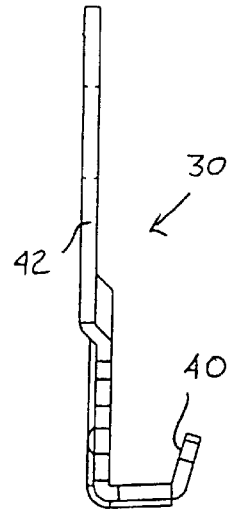
FIG. 6 is a side view of the actuating lever of the present invention with the cushion member removed therefrom.

As shown in FIG. 5, the upper portion of the main body 34 includes a flat or substantially flat tab 42 having a pair of spaced-apart apertures 44 therein. The tab 42 has a curved perimeter edge which includes a convexly-curved upper edge 46 and a pair of concavely-curved side edges 48. The curvature of the concavely-curved side edges 48 flows smoothly into the convexly-curved upper edge 46.

Figure 7:
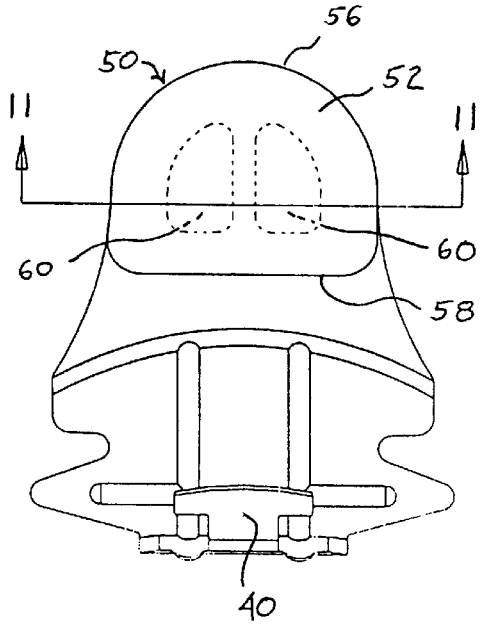
FIG. 7 is a view of the inner side of the actuating lever with the cushion member thereon.
Figure 8:
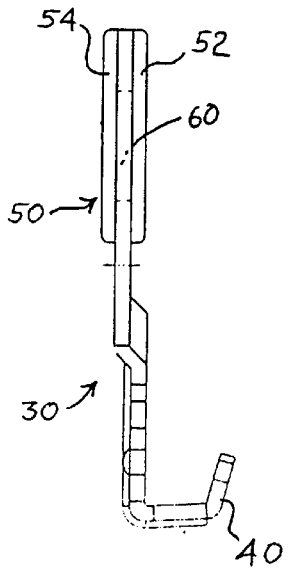
FIG. 8 is a side view of the actuating lever with the cushion member thereon.
Figure 9:
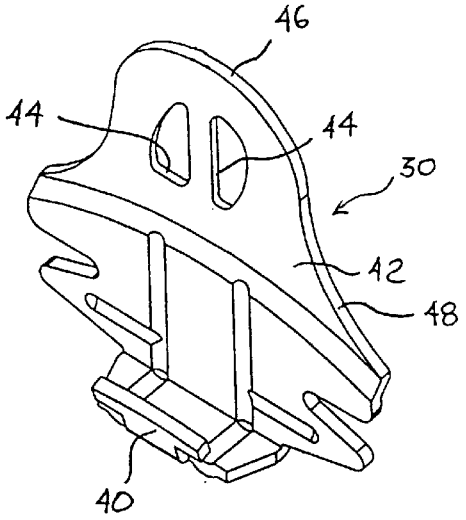
FIG. 9 is a perspective view of an inner side of the actuating lever without the cushion member thereon.

Referring now to FIGS. 7 and 8, a cushion member 50 of the present invention is shown. The cushion member 50 is a soft pad of material, which is preferably formed of plastic. The cushion member 50 is large enough to cover the upper portions of the faces of the tab 42 so that the user's fingers do not touch any rough or slippery surfaces which may exist on the tab 42, but instead touch the soft face of the cushion member 50.

The cushion member 50 has an inner cushion part 52 and an outer cushion part 54. The inner cushion part 52 refers to the part of the cushion member 50 closest to the rings 28 when the cushion member 50 is installed on the tab 42, and the outer cushion part 54 refers to the part of the cushion member 50 furthest from the rings 28 when the cushion member 50 is installed on the tab 42. The inner cushion part 52 is engaged by the finger of a user to pivot the actuating lever 30 to move the ring members 28 to the 22 has a flange 24 which forms a base for the ring binder 10 for attachment to the cover.

A pair of hinged leaves 26 are supported by the curved upper plate 12. The curved upper plate 12 provides a biasing force on the hinged leaves 26 such that the hinged leaves 26 move in an overcenter manner. A plurality of ring members 28 are secured to the hinged leaves 26 for engaging corresponding holes in sheets of material retained by the ring binder 10.

An actuating lever 30 is located at each end of the curved upper plate 12 for actuating the hinged leaves 26 to open and close the ring members 28. When the ring members 28 of the ring binder 10 are in a closed position, movement of the actuating levers 30 away from one another causes a central hinge portion 32 of the hinged leaves 26 to move toward the curved upper plate 12, thereby causing the ring members 28, which move with the hinged leaves 26, to move to an open position. Conversely, when the ring members 28 of the ring binder 10 are in an open position, movement of the actuating levers 30 toward one another causes the central hinge portion 32 of the hinged leaves 26 to move away from the curved upper plate 12, thereby causing the ring members 28 to return to the closed position. A known ring binder including a conventional opening/closing mechanism with an actuating lever is more fully disclosed in U.S. Pat. No. 5,354,142, the entire contents of which are hereby incorporated by reference.

Referring now to FIGS. 5–10, an actuating lever 30 of the present invention is shown, which includes a main body 34 made of metal having a nickel plated finish. Each actuating lever 30 includes a plurality of reinforcing ribs 36 thereon to increase the rigidity of the main body 34. The main body 34 further includes a open position, and the outer cushion part 54 is engaged by the finger of a user to pivot the actuating lever 30 to move the ring members 28 to the closed position.

Figure 10:
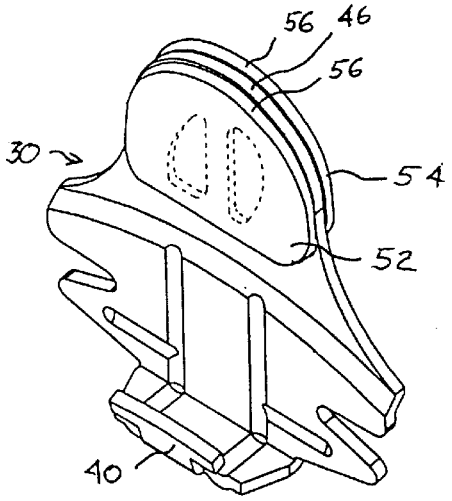
FIG. 10 is a perspective view of the inner side of the actuating lever with the cushion member assembled thereto.

As shown in FIG. 7, the inner cushion part 52 and the outer cushion part 54 of the cushion member 50 each have a perimeter wall including a convexly-curved upper wall 56 and a generally straight lower wall 58, although many other shapes may be utilized including circular, oval, polygonal, etc. The inner cushion part 52 of the cushion member 50 and the outer cushion part 54 of the cushion member 50 have faces which are preferably flat as shown in FIGS. 7, 8 and 10, although dimples or projections may be formed thereon if desired. As shown in FIGS. 8 and 10, when the cushion member 50 is formed on the tab 42, the convexly-curved upper edge 46 and the pair of concavely-curved side edges 48 of the tab 42 remain visible. In the preferred embodiment, no portion of the cushion member 50 passes over the convexly-curved upper edge 46 and the pair of concavely-curved side edges 48 of the tab 42 from the inner cushion part 52 to the outer cushion part 54.

In the preferred embodiment, the cushion member 50 is molded onto the tab 42 such that the cushion member 50 is a one-piece unitary integral member. To form the cushion member 50 on the tab 42, the actuating lever 30 is placed into a molding machine (not shown), with the tab 42 encased in an injection mold of the machine. The machine then injects melted cushion material, such as plastics, into the mold, and the cushion member 50 is thus formed snugly around the tab 42.

Figure 11:
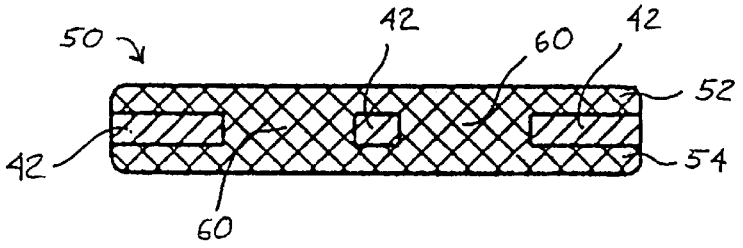
FIG. 11 is a cross-sectional view of the cushion member of the present invention.

Because the tab 42 includes the spaced-apart apertures 44 therein, material of the cushion member 50 passes into the apertures 44 to form a pair of spaced-apart connecting parts 60 which join the inner cushion part 52 to the outer cushion part 54 as shown in FIG. 11, to securely hold the cushion member onto the tab 42. Accordingly, the inner cushion part 52, the outer cushion part 54, and the connecting parts 60 are integrally formed together as one piece onto the tab 42. The connecting parts 60 have a perimeter shape matching a perimeter shape of the apertures 44. The perimeter shape of the apertures 44 is preferably non-circular as shown in FIG. 5, although circular apertures may be used. Because a pair of spaced-apart apertures 44 and a pair of spaced-apart connecting parts 60 are utilized, the cushion member 50 is prevented from spinning or rotating on the tab 42.

Although the cushion member 50 is preferably formed of plastic, it is conceived that other cushioning materials such as rubber, elastomers, dense foam, or any suitable moldable material may be utilized. Also, the cushion member 50 may be formed of different colors to coordinate the ring binder 10 with the cover member, or with the subject matter of the items contained within the loose-leaf binder.

Although the main body 34 of the actuating lever 30 is made of stamped metal having a nickel plated finish, it is possible to utilize other suitable strong and rigid materials, such as plastic, without departing from the invention.

Although the preferred embodiments described herein utilize two apertures 44 in the tab 42, it should be understood that fewer or more apertures 44 may be provided in the tab 42 if desired. However, where only one aperture 44 is used, it may be desirable to utilize an irregularly-shaped aperture 44 in order to prevent the cushion member 50 from spinning or rotating on the tab 42. Also, although the preferred embodiment of the tab 42 described herein has a curved perimeter edge, it should be understood that other perimeter shapes of the tab 42 may be utilized if desired, such as a rectangular tab.

It should be understood that while the preferred embodiment describes the ring binder 10 as being attached to the spine of the cover member, the ring binder may instead be attached to the front cover or the back cover. Also, although three ring members 28 are shown in FIGS. 1–4, it should be understood that any number and arrangement of ring members 28 may be utilized. For example, two or four ring members may be utilized. Also, the ring members 28 may be equally spaced-apart, or may have different spacings. Finally, although the ring members 28 shown are circular, it is envisioned that D-shaped or other ring shapes may be utilized.

Although the actuating lever cushion member 50 of the present invention has been described for use with a ring binder having a curved upper plate 12 with a pair of first reinforcing ribs 14 and several pairs of second ribs 16, it should be understood that the actuating lever cushion member 50 may be used with differently shaped upper plates which do not include reinforcing ribs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A ring binder comprising:

an upper plate;

a pair of hinged leaves supported by said upper plate;

a plurality of rings attached to said hinged leaves and movable therewith;

at least one pivotable actuating lever for moving said hinged leaves from a first position where said rings are closed, to a second position where said rings are open, said actuating lever including a tab at an upper end portion thereof, said tab having a pair of spaced-apart apertures therein; and a cushion member including an inner cushion part located on an inner face of said tab, an outer cushion part located on an outer face of said tab, and a pair of spaced-apart connecting parts which extend through said spaced-apart apertures in said tab to securely attach said cushion member to said tab.

2. The ring binder according to claim 1, wherein said inner cushion part, said outer cushion part, and said connecting parts are integrally formed together as a one-piece unitary member.

3. The ring binder according to claim 1, wherein said cushion member is formed of plastics.

4. The ring binder according to claim 1, wherein said connecting parts extend from an inner face of said inner cushion part to an inner face of said outer cushion part.

5. The ring binder according to claim 1, wherein said apertures have a non-circular perimeter, and said connecting parts have a perimeter matching said non-circular perimeter of said apertures.

6. The ring binder according to claim 1, wherein an upper end of said tab has a convexly-curved perimeter edge contour, and said inner cushion part and said outer cushion part have curved upper walls which follow the convexly-curved perimeter edge contour of said tab.

7. The ring binder according to claim 1, wherein said tab has a perimeter edge, and no portion of said cushion member passes over said perimeter edge of said tab from said inner cushion part to said outer cushion part.

8. The ring binder according to claim 7, wherein said perimeter edge of said tab includes a convexly-curved perimeter edge contour, and said inner cushion part and said outer cushion part have curved upper walls which follow the convexly-curved perimeter edge contour of said tab.

9. The ring binder according to claim 8, wherein said connecting parts extend from an inner face of said inner cushion part to an inner face of said outer cushion part.

10. The ring binder according to claim 9, wherein said inner cushion part, said outer cushion part, and said connecting parts are integrally formed together as a one-piece unitary member.

11. In combination, a ring binder having a pivotable actuating lever including a tab at an upper end portion thereof having a pair of spaced-apart apertures therein, and a cushion member including an inner cushion part located on an inner face of said tab, an outer cushion part located on an outer face of said tab, and a pair of spaced-apart connecting parts which extend through said spaced-apart apertures in said tab to securely attach said cushion member to said tab.

12. The combination according to claim 11, wherein said inner cushion part, said outer cushion part, and said connecting parts are integrally formed together as a one-piece unitary member.

13. The combination according to claim 11, wherein said cushion member is formed of plastics.

14. The combination according to claim 11, wherein said connecting parts extend from an inner face of said inner cushion part to an inner face of said outer cushion part.

15. The combination according to claim 11, wherein said apertures have a non-circular perimeter, and said connecting parts have a perimeter matching said non-circular perimeter of said apertures.

16. The combination according to claim 11, wherein an upper end of said tab has a convexly-curved perimeter edge contour, and said inner cushion part and said outer cushion part have curved upper walls which follow the convexly-curved perimeter edge contour of said tab.

17. The combination according to claim 11, wherein said tab has a perimeter edge, and no portion of said cushion member passes over said perimeter edge of said tab from said inner cushion part to said outer cushion part.

18. The combination according to claim 17, wherein said perimeter edge of said tab includes a convexly-curved perimeter edge contour, and said inner cushion part and said outer cushion part have curved upper walls which follow the convexly-curved perimeter edge contour of said tab.

19. The combination according to claim 18, wherein said connecting parts extend from an inner face of said inner cushion part to an inner face of said outer cushion part.

20. The combination according to claim 19, wherein said inner cushion part, said outer cushion part, and said connecting parts are integrally formed together as a one-piece unitary member.

* * * * *